United States Patent [19]

John et al.

[11] 4,257,665

[45] Mar. 24, 1981

[54] POLARIZED ELECTRICAL CONNECTOR

[75] Inventors: Heinrich John, Rodgau; Eike Koster, Eppertshausen, both of Fed. Rep. of Germany

[73] Assignee: AMP Incorporated, Harrisburg, Pa.

[21] Appl. No.: 6,414

[22] Filed: Jan. 25, 1979

[30] Foreign Application Priority Data

Feb. 1, 1978 [GB] United Kingdom ..... 4379/78

[51] Int. Cl.[3] ..... H01R 13/645

[52] U.S. Cl. ..... 339/186 M; 339/91 A

[58] Field of Search ..... 339/45 M, 75 RM, 91 R, 339/126 R, 103 M, 189 M, 186 MR; D13/24

[56] References Cited

U.S. PATENT DOCUMENTS

| | | | |
|---|---|---|---|
| 2,899,669 | 8/1959 | Johanson | 339/91 R X |
| 3,459,396 | 8/1969 | Buttriss | 339/126 R X |
| 3,633,152 | 1/1972 | Podmore | 339/91 R |
| 3,728,664 | 4/1973 | Hurst | 339/91 R |
| 4,046,449 | 9/1977 | Ranzanigo | 339/126 R |
| 4,082,400 | 4/1978 | Gansert | 339/91 R |
| 4,113,337 | 9/1978 | McKee | 339/126 R X |

*Primary Examiner*—Eugene F. Desmond

*Attorney, Agent, or Firm*—Jay L. Seitchik; David C. Ripma

[57] ABSTRACT

A two-part connector has an arm on one part with a configured tip keyed to an aperture in an end wall of the hood of the other part. The tip can be engaged with the aperture when the two parts are inclined and mating is effected by relative pivotal movement.

3 Claims, 6 Drawing Figures

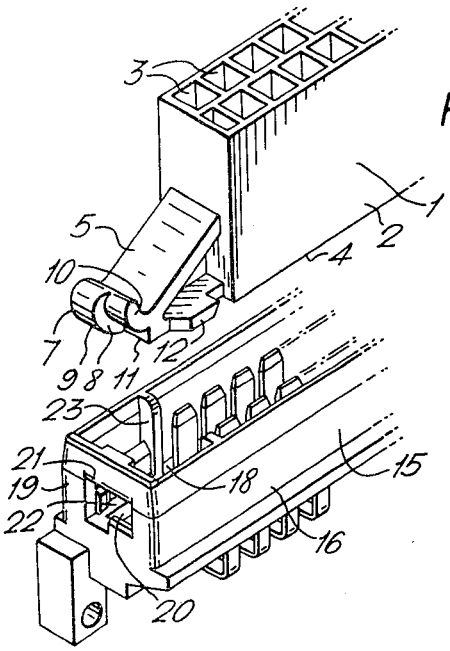
FIG.1.
FIG.2.
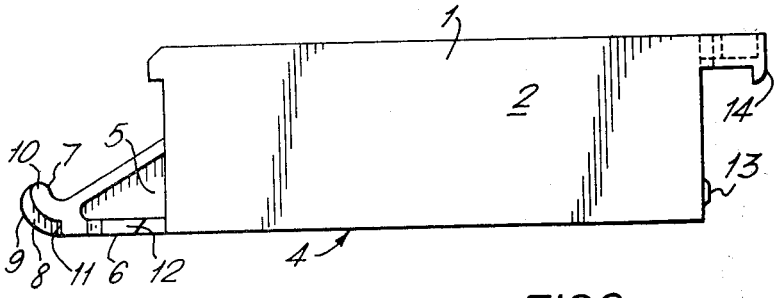
FIG.3.
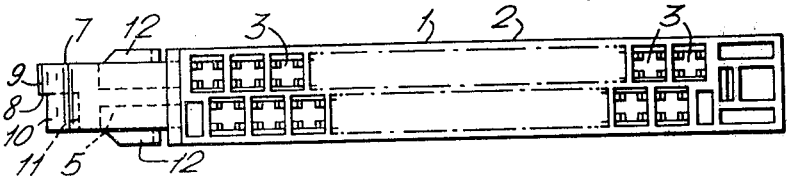

FIG.4.
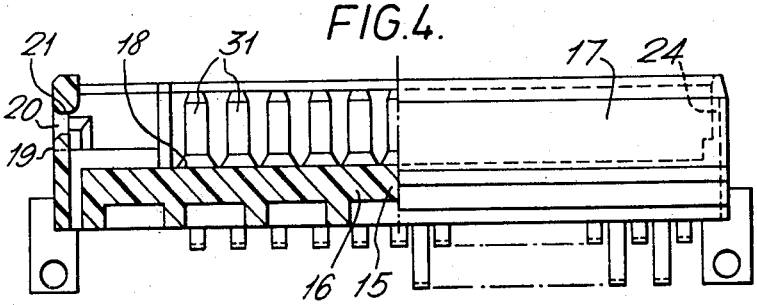
FIG.5.
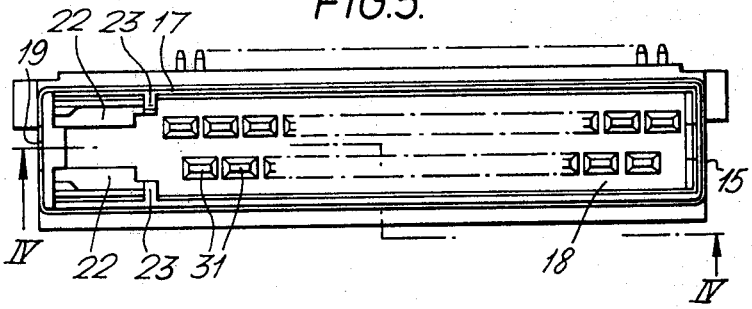
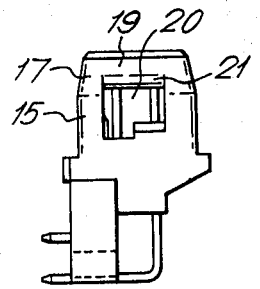
FIG.6.

POLARIZED ELECTRICAL CONNECTOR

This invention relates to an electrical connector with a polarising feature.

It is an object of the invention to provide a two-part electrical connector with means to polarise the parts, guarding against mis-mating and facilitating engagement.

A two-part electrical connector according to the present invention comprises a first housing part of generally rectangular slab-like form and slidably receivable within a hood-portion of a complementary second housing part, to engage respective contacts of the housing parts, characterised in that the first housing part is formed at an end with an extension having a tip configured in cross-section and the hood-portion of the second part is extended in complementary manner by a lesser amount, the end wall of the extended hood portion being formed with a close-walled aperture, configured in complementary manner to the tip of the extension.

In order to mate the two housing parts it is necessary to register the tip of the extension with the aperture by positioning the housing parts at an appropriate inclination, move the tip through the aperture so that the first housing part can be pivoted about the tip to move into the hood and effect mating of the housing parts by pivotal action.

Suitably the tip of the extension is turned in arcuate fashion away from the mating direction.

As a result the first housing part must be inclined to the mating direction and second housing part in order to register the tip with the complementary aperture in the end wall of the hood of the second housing part. When the tip is registered with the aperture the first housing part may be pivoted about the arcuate portion, allowing the tip to penetrate the aperture and the connector parts to move gradually into mating engagement.

The cross-section of the tip is suitably stepped to present portions of different thickness in the mating direction, and keying with complementary parts of the hood aperture. Thus, where incorrect parts are brought together, and keying does not take place the tip cannot penetrate the aperture and the pivotal action cannot take place.

The second housing part is formed within the hood and adjacent the aperture with a guide channel for guiding the tip of the extension towards the aperture.

The first housing part and the hood are suitably formed at their ends opposite the extension and the aperture with snap fit engagement means for releasably holding the connector parts in mating engagement.

The invention will now be described, by way of example with reference to the accompanying partly diagrammatic drawings, in which:

FIG. 1 is a fragmentary perspective view of a two-part connector prior to mating engagement;

FIG. 2 is a side elevation of a first part of the connector of FIG. 1;

FIG. 3 is a plan view of the connector part of FIG. 2;

FIG. 4 is a side elevation of the second part of the connector of FIG. 1;

FIG. 5 is a plan view of the connector part of FIG. 4, and

FIG. 6 is a view of the connector part from the left-hand end of FIG. 4.

The first housing part 1 of the two-part connector of FIG. 1 comprises as seen more clearly in FIGS. 2 and 3 a generally rectangular slab-like body 2 formed with a plurality of contact cavities 3 for receiving receptacle contacts not shown and opening to a mating face 4. At the left-hand end as seen in FIGS. 2 and 3 the body 2 is formed with an extension 5 of lesser width than the body 2, and having a lower surface 6 flush with the mating face 4. The extension 5 tapers, as seen in side view, to a tip portion 7 which is turned up in arcuate fashion, away from the mating face 4. The tip portion 7 is formed with a configured cross-section to present a step 8 between portions 9,10 of different thickness having respective arcuate lower surfaces. The step 8 terminates at a shoulder 11 extending from the portion 9 of reduced thickness, to the mating face 4.

The extension 5 is formed at opposite sides, adjacent the mating face 4, and between the tip portion 7 and the body 2 with flanges 12 having outer edges level with sides of the body 2. Ends of the flanges 12 facing the tip 7 are beveled inwardly towards the tip and edges facing the body 2 are beveled downwardly and away from the body 2 as seen in FIG. 2.

The body 2 at the end opposite to the extension 5 is formed at a lower part, as seen in FIG. 2, with a small protuberance 13, and at its side remote from the mating face 4 with a projection 14.

The second housing part 15 of FIG. 1 comprises a generally rectangular body 16 having on its upper side, as seen in FIGS. 1 and 4, a hood portion 17 for receiving the first housing part 1. The hood 17 extends above a mating face 18, and a plurality of contact tabs 31 arranged in complementary manner to the contact cavities 3 of the first part 1, project normally from the face 18 within the hood 17. The hood 17, at its left-hand end wall 19 as seen in FIG. 4, is formed with an aperture 20, complementary in cross-section, as seen in FIG. 6, to that of the tip portion 7 of the extension 5 of the first housing part 1. The wall 19 above the aperture 20 is thickened and formed with a lower arcuately convex surface 21.

Inwardly of the wall 19, the second housing part 15 is formed between the wall 19 and the array of contact tabs 31 with shoulders 22 at the opposite sides of the hood 17 and extending to the end wall 19 from a location short of the array of contact tabs 31 at which location ribs 23 project upwardly from the shoulders to the upper edge of the hood 17. The shoulders 19 present a guide channel for receiving the tip 7 of the extension, and guiding it towards the aperture 20. The ribs 23 are arranged to engage those ends of the flanges 12 which face the body 2 of the first connector part.

The hood 17 at its right-hand end as seen in FIG. 4, is formed with a notch 24 defining a shoulder for engaging the protuberance 13 of the first connector part in a snap fit when the connector parts are mated.

In use, the connector parts 1,15 are mated by inserting the tip 7 of the first part 1 into the cavity defined within the hood portion 17 of the second part 15, between the ribs 23 and the end wall 19 until the tip 7 engages the guide shoulders 22. This necessitates the first part 1 being inclined to the second part 15 at an appropriate angle. The tip 7 may then be slid along the shoulders 22 until it registers with the aperture 20. When the tip 7 has penetrated the aperture 20 and the right-hand ends of the flanges 12 of the first part have cleared the upper edges of the ribs 23, the first part 1 may be pivoted about its arcuate portions which engage the lower edge of the aperture 20 to move the connector parts 1,15 gradually into engagement. Side edges of the flanges 12 engage sides of the hood 17 to assist in transverse alignment, and registration of the tip 7 and aperture 20 assist in longitudinal alignment and proper guiding of the mating faces 4,18 together.

When the protuberance 13 engages the upper edge of the hood 17 the hood wall is deflected so that the shoulder of the notch 24 may engage the protuberance 13 in a snap fit.

It should be understood that the cross-sectional forms of the aperture 20 and tip 7 may be varied in connectors of the same basic form to key respective parts and avoid risk of mis-mating.

We claim:

1. A two part electrical connector comprising a first housing part of generally rectangular slab like form and slidably receivable within a hood portion of a complementary second housing part to engage respective contacts of the housing parts, said first housing part including an extension at one end thereof, said extension being elongated and having a tip at the end thereof engageable with an aperture associated with said second housing part, said tip having a stepped configuration including portions of different thickness measured across the width of said extension, said portions of different thickness each including an arcuate surface facing in the mating direction of the housing parts whereby said arcuate surfaces allow for pivotal movement between said housing parts to mate said housing parts when said tip engages said aperture, said aperture of said second housing part being formed in an endwall of said hood and having a stepped configuration complementary to said tip of said extension.

2. A connector as in claim 1 in which said extension is tapered along its length to said tip and in which said tip is turned upwardly to form said arcuate surfaces.

3. A connector as in claim 1 in which said second housing part includes a guide channel for receiving said tip of said extension on said first housing part for guiding said tip into said aperture.

* * * * *